United States Patent [19]

Hoagland

[11] 4,345,756

[45] Aug. 24, 1982

[54] ADJUSTABLE DUMBBELL APPARATUS

[76] Inventor: Jesse Hoagland, 333 Bellevue Ave., Trenton, N.J. 08618

[21] Appl. No.: 211,879

[22] Filed: Dec. 1, 1980

[51] Int. Cl.[3] ..... A63B 21/06

[52] U.S. Cl. ..... 272/117; 272/143; 272/DIG. 4

[58] Field of Search ..... 272/119, 122, 123, 124, 272/143, 67, 68, 93

[56] References Cited

U.S. PATENT DOCUMENTS

| | | | |
|---|---|---|---|
| 734,062 | 7/1903 | Harris | 272/122 |
| 1,333,005 | 3/1920 | Warner | 272/143 X |
| 2,617,650 | 11/1952 | Landis | 272/122 |
| 2,819,081 | 1/1958 | Touraine | 272/67 |
| 4,039,183 | 8/1977 | Sakurada | 272/67 |
| 4,109,908 | 8/1978 | Pugh et al. | 272/119 |
| 4,231,569 | 11/1980 | Rae | 272/67 X |

*Primary Examiner*—Richard C. Pinkham
*Assistant Examiner*—William R. Browne
*Attorney, Agent, or Firm*—John J. Kane; Frederick A. Zoda; Albert Sperry

[57] ABSTRACT

An adjustable dumbbell apparatus is disclosed which is particularly adapted to maintain the arms of the exerciser in a straight orientation when used with weighted members which includes a circumferential member defining a hole therethrough through which the arm of the exerciser is adapted to extend. A first and second strut are fixedly secured to the circumferential member to be parallel with respect to the hole therein and extend upwardly therefrom. A grip extends between the upper ends of the struts such that the user can grasp this grip when his arm is extending through the hole in the circumferential member. A weighted support bar is adapted to extend outwardly from the circumferential member and is fixedly secured thereto. The weighted support member extends outwardly perpendicular approximately with respect to the axis of the hole in such a fashion as to use the weights when placed on the weight support member to urge the arm of the exerciser into the straight orientation. Alternatively, a collar may be threadably securable to the externally threaded bar of the weight support member to facilitate securement of weighted members thereto. Also alternatively, the individual struts may be formed of an outer tubular member and an inner member which telescopically moves with respect to one another to adjust the distance between the circumferential member and the grip.

8 Claims, 3 Drawing Figures

ADJUSTABLE DUMBBELL APPARATUS

BACKGROUND OF THE INVENTION

1. Field of the Invention

The present invention deals with the field of apparatus usable for dumbbell-type weightlifting exercise wherein a smaller weight is adapted to be moved by a single arm rather than a large weight and a large bar by both arms. The present invention provides an improved dumbbell apparatus for usage specifically with exercises for developing the pectoral muscles wherein it is desirable to have the arm extended and straight during the exercises in order to maximize effectiveness thereof.

2. Description of the Prior Art

Previously patented items to provide adjustable dumbbells are disclosed in U.S. Pat. Nos. 2,617,650; 4,039,183; 4,109,908 and 2,819,081. These designs provide various means for adjusting the dumbbell-type apparatus or for exercising of the hand and forearm. The present invention is novel from any of these designs particularly by the orientation chosen for the weight support member.

SUMMARY OF THE INVENTION

The present invention provides an adjustable dumbbell apparatus which is particularly adapted to maintain the arms of the exerciser in a straight orientation when used with weighted members which includes a circumferential member which defines a hole. This hole is adapted to receive the arm of the exerciser extending therethrough during usage of the dumbbell apparatus.

A strut configuration is adapted to be fixedly secured with respect to the inner side of the circumferential member to extend upwardly therefrom approximately parallel to the axis of the arm of a user when it extends through the hole of the circumferential member. In this manner the struts will extend along the forearm and wrist area of the exerciser. It is particularly advantageous to utilize two strut members each being secured at opposite inner edges of the circumferential member to extend upwardly therefrom. With this configuration the upper ends of each strut member will provide the mounting location for a grip means which extends approximately perpendicular with respect thereto to provide a location for grasping by the hand of the exerciser.

A weighted support member is included which is fixedly secured with respect to the outer side of the circumferential member in such a fashion as to extend outwardly therefrom approximately perpendicularly with respect to the axis of the hole and also with respect to the strut means. In this manner the weighted support means will be adapted to receive weight means secured thereon in order to increase or decrease the effectiveness of the exercise.

Each strut member preferably includes an inner member and an outer tubular member which are movably positioned with respect to one another in order to telescope with respect to one another. In this manner the distance between the grip means and the circumferential member can be varied to be adaptable for usage with different persons having different lengths between their elbow and hand. This is necessary since it is desirable if possible to have the circumferential member extend about the elbow area of an exerciser. This adjustment feature preferably includes a detachable securement means which is adapted to selectively secure each outer tubular member with respect to an inner member once the desired distance has been achieved.

The circumferential member may further include a lining means extending about the peripheral area of the hole defined therein in order to pad the inner edge thereof to facilitate comfort of the arm of the exerciser during usage. Also to facilitate comfort the strut means may be adapted to be bent slightly inwardly in an oblique manner from the inner side of the circumferential member. In this manner a relaxed, grasping position of the wrist can be more effectively achieved.

The weighted support member may include an externally threaded bar and the dumbbell apparatus may include a collar means which defines an internally threaded aperture therethrough. These internal threads of the collar means and the external threads of the threaded bar should be matched such that the collar may be threaded onto the bar to facilitate securement of weighted members thereto.

It is an object of the present invention to provide an adjustable dumbbell apparatus which is particularly adapted to maintain the arms of the exerciser in a straight orientation when used with weighted members.

It is an object of the present invention to provide an adjustable dumbbell apparatus which is particularly usable for the development of the pectoral muscles of the exerciser.

It is an object of the present invention to provide an adjustable dumbbell apparatus which utilizes the placement of the weight means in order to increase the intensity of the exercise as well as to decrease the tendency of the user to bend the arm and thereby reduce the effectiveness of the exercise.

It is an object of the present invention to provide an adjustable dumbbell apparatus which can be varied in length between a gripping means and a forearm or elbow support means in order to be adapted for usage with different persons having different distances between the elbow and the hand.

It is an object of the present invention to provide an adjustable dumbbell apparatus which is safe in operation by the usage of a threaded collar and a threaded weight support bar to facilitate securement of the weighted members with respect to the apparatus.

It is an object of the present invention to provide an adjustable dumbbell apparatus which includes a padded lining to facilitate comfort of contact between the dumbbell apparatus and the arm of the exerciser.

It is an object of the present invention to provide an adjustable dumbbell apparatus which includes a gripping means extending obliquely inward from the axis of the aperture to which the arm of the user extends in order to facilitate comfort of grasping of the hand with the wrist being placed in a relaxed orientation.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
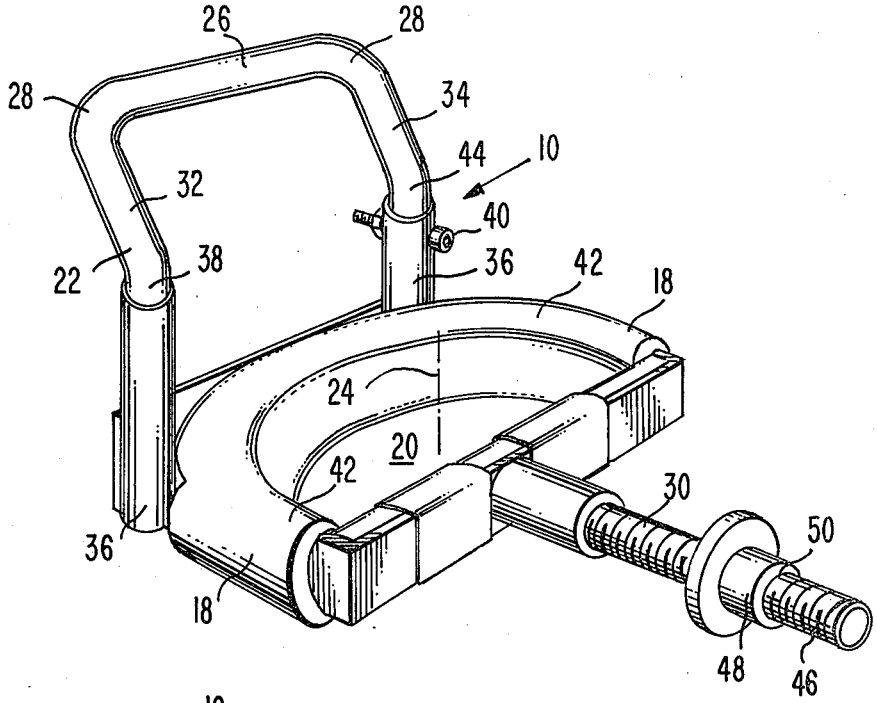
FIG. 1 is a perspective illustration of an embodiment of the adjustable dumbbell apparatus of the present invention.

The dumbbell apparatus 10 of the present invention is usable by an exerciser 14 by the extending of his arm 12 therethrough. A circumferential member 18 defines a hole 20 therethrough through which the arm 12 may extend.

Figure 2:
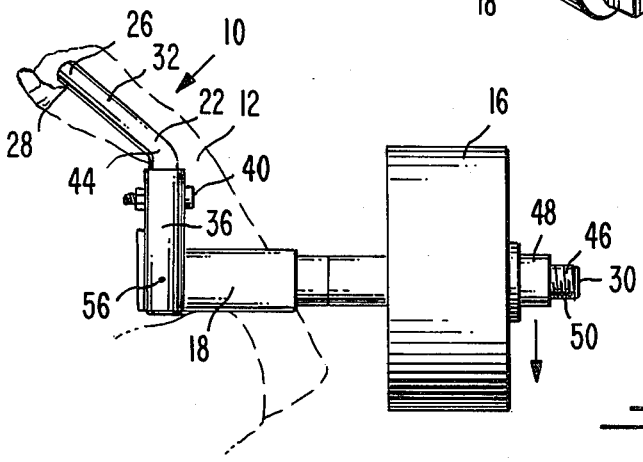
FIG. 2 is a side view of an embodiment of an adjustable dumbbell apparatus of the present invention showing grasping thereof by an exerciser.

A strut means 22 preferably is fixedly secured with respect to the inner side of the circumferential member in such a fashion as to extend upwardly therefrom in the direction such that it extends approximately parallel to the axis of the hole defined within the circumferential member. In this manner the strut means will extend along the forearm and wrist area of the exerciser and will terminate with the upper end thereof approximately adjacent to the hand of the exerciser. The axis 24 of hole 20 is shown in FIG. 2 with the strut means 22 extending upwardly parallel with respect thereto.

A grip means 26 is adapted to be fixedly secured with respect to the strut means 22 at the upper end thereof in such a fashion as to allow the user to grasp the grip means 26. In a preferred configuration the strut means 22 will include a first strut member 32 and a second strut member 34 each extending upwardly from opposite inner edges of the circumferential member 18. With this configuration the upper ends 28 of the strut means 22 will be positioned adjacent to the hand of the exerciser 14. The grip means 26 will then be fixedly secured with respect to the upper ends 28 of the first strut member 32 and the second strut member 34 such as to extend horizontally with respect thereto and therefore also horizontally with respect to the hole 20. It is also preferable that the individual strut means 22 will have an obliquely inward bend 44 in order to allow the wrist of the exerciser to be in a relaxed inwardly bending configuration during performance of the exercise.

The dumbbell apparatus 10 of the present invention also preferably includes a weight support member 30 adapted to receive weighted members 16 mounted thereon to control the weight of the dumbbell apparatus and thereby the effectiveness of the exercise. The weight means 12 are secured to the weight support member 30 by any conventional means. However, preferably, the weight support member 30 includes an externally threaded bar 46 which is mated to an internally threaded collar means 48. That is, the collar means 48 defines an internally threaded aperture 50 therethrough such that when a weight means 16 is placed on the bar as shown in FIG. 2, the collar means 48 may be threaded on to the externally threaded bar 46. This additional measure of safety is particularly preferable since the weight means will be changed from a vertical orientation during most exercises of the dumbbell apparatus 10 of the present invention and it is particularly important that the weights be fixedly secured with respect thereto.

During the performance of an exercise it is preferable that the circumferential member 18 extend around the arm 12 of the exerciser 14 approximately in the area of his elbow. In order to provide for different individuals who have different distances between the hand and the elbow it is preferable to provide the first strut member 32 and the second strut member 34 to be adjustable in length. This is achieved by the formation of each strut member having an outer tubular member 36 and an inner member 38. These members are adapted to telescope in movement with respect to one another in such a fashion as to vary the length. As shown in FIG. 1 a detachable securememt means 40 may extend through apertures defined in the inner and outer member which are matched such that placement of the detachable securement means 40 such as a bolt or the like through the registered holes will fixedly secure the outer tubular member 36 with respect to the inner member 38.

To further facilitate comfort of usage by the exerciser 14 a lining means 42 may be included about the inner periphery of the circumferential member 18. This lining means is preferably padded in order to minimize fatigue between the material of the circumferential member 18 and the arm 12 of the exerciser 14 particularly in the area of the elbow.

Figure 3:
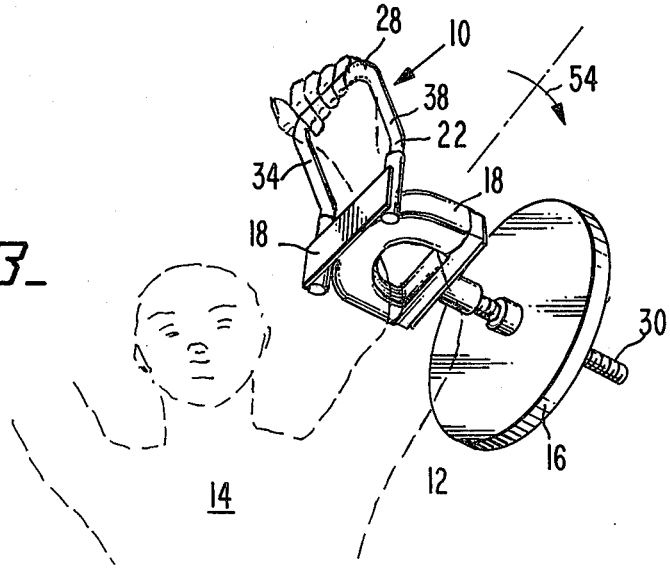
FIG. 3 shows the usage of an embodiment of the adjustable dumbbell apparatus of the present invention when used doing a laterally extending dumbbell lifting exercise when the exerciser is laying on a bench or floor.

The present invention provides a novel adjustable dumbbell apparatus which has been carefully designed to place the weight of the dumbbell on a bar 46 extending outwardly from the elbow of the user. In this manner a force will be exerted along arrows 52 as shown in FIG. 2 or 54 as shown in FIG. 3 to assure the maintaining of the arm of the exerciser in a straight orientation. As shown in FIG. 2 particularly the downwardly exerted bias of the weight 16 about the moment arm of the externally threaded bar 46 will cause a rotation of the dumbbell apparatus 10 about the approximate axis 56 which will tend to bend the forearm of the exerciser clockwise and lock the arm in the extended position.

Similarly as shown in FIG. 3 when performing lateral butterfly lifts when on an exercising bench the force will be created along arrow 54 by the weight 16 being placed on the weighted support member extending outwardly from the elbow of the exerciser in such a fashion as to lock his arm in the extended position. He is now pulling the apparatus 10 with his pectoral muscles with a 100% efficiency of pulling movement. Other exercises are also performed with full advantageous usage of the ability of apparatus 10 to maintain the arms 12 in a straight orientation. It should be appreciated that this force to lock the arm in the open position is completely independent of the force which the exerciser must overcome to actually perform the exercise. That is entirely independent. Due to the distance between the hinge of the shoulder and the weight of the present dumbbell apparatus being shorter than the normal distance where the weight is held outwardly at the hand, it has been demonstrated that an exerciser can use significantly greater weight with the dumbbell apparatus of the present invention than with conventional dumbbells.

While particular embodiments of this invention have been shown in the drawings and described above, it will be apparent that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An adjustable dumbbell apparatus, particularly adapted to maintain the arms of the exerciser in a straight orientation when used with weighted members, which comprises:

(a) a circumferential member defining a hole therein through which the arm of the exerciser extends, said hole defining a hole axis therethrough extending through the center of said hole perpendicular to a plane defined by said circumferential member;

(b) a strut means being fixedly secured with respect to the inner side of said circumferential member and extending upwardly therefrom approximately parallel to said hole axis to extend along the forearm and wrist area of an exerciser;

(c) a grip means detachably secured with respect to said strut means and including a horizontal portion thereof extending approximately perpendicular with respect to said strut means to provide a location for grasping by the hand of the exerciser; and (d) a weight support member being fixedly secured with respect to said cicumferential member at a location opposite from said strut means and extending therefrom approximately perpendicular with respect to said hole axis and with respect to said strut means and said grip means, said weight support means adapted to receive variously weighted members secured thereon to control the intensity of the exercise.

2. The apparatus as defined in claim 1 wherein said strut means comprises a first strut member and a second strut member each fixedly secured at their lower ends to said circumferential member.

3. The apparatus as defined in claim 2 wherein said first strut member and said second strut member each include an outer tubular member and said grip means including an inner member movably positioned inside of said outer tubular members to adjustably control the distance between said horizontal portion of said grip means and said circumferential member by telescoping movement therebetween, said first strut member and said second strut member further including detachable securement means adapted to selectively fixedly secure one of said tubular members with respect to the associated one of said inner members.

4. The apparatus as defined in claim 1 further including a lining means extending about the peripheral area of said hole to pad the inner edge thereof to facilitate comfort of the arm of the exerciser during use.

5. The apparatus as defined in claim 1 wherein said strut means extends obliquely away from said circumferential member to facilitate grasping of said grip means.

6. The apparatus as defined in claim 1 wherein said weight support member includes an externally threaded bar and wherein said adjustable dumbbell apparatus further includes a collar means defining an internally threaded aperture therethrough matched to the external threads of said bar to allow said collar means to be detachably screwed to said bar to facilitate securement of weighted members thereto.

7. The apparatus as defined in claim 1 further comprising weight means to the dumbbell apparatus.

8. An adjustable dumbbell apparatus, particularly adapted to maintain the arms of the exerciser in a straight orientation when used with weighted members, which comprises:

(a) a circumferential member defining a hole therein through which the arm of the exerciser extends, said hole defining a hole axis therethrough extending through the center of said hole perpendicular to a plane defined by said circumferential member said circumferential member further including a lining means extending about the peripheral inner area of said hole to pad the inner edge thereof to facilitate comfort of the arm of the exerciser during use;

(b) a strut means comprising a first strut member and a second strut member each being fixedly secured at their lower ends to said circumferential member to extend along the forearm and wrist area of an exerciser, each of said fist strut members and said second strut members including an outer tubular member and an inner member movably positioned therein to adjustably control the length of said first strut member and said second strut member by telescoping movement therebetween, said first strut member and said second strut member further including a detachable securement means adapted to selectively fixedly secure each of said outer tubular member with respect to the associated inner member;

(c) a grip means detachably secured at opposite ends thereof with respect to said first strut member and said second strut member by and extending approximately perpendicular with respect thereto to provide a location for grasping by the hand of the exerciser, said strut means obliquely away from the inner side of said circumferential member in order to facilitate grasping of said grip means secured to the upper ends thereof;

(d) a weight support member being fixedly secured with respect to said circumferential member at the opposite side from said strut means and extending therefrom approximately perpendicular with respect to said hole axis and with respect to said strut means and said grip means, said weight support means adapted to receive variously weighted members secured thereon to control the intensity of the exercise, said weigh support member including an externally threaded bar;

(e) a collar means defining an internally threaded aperture therethrough matched to the external threads of said bar of said weight support member to allow said collar means to be detachably screwed to said bar to facilitate securement of weighted members thereto; and (f) weight means detachably securable with respect to said weight support member to be fixedly secured thereon by attachment of said internally threaded collar means to said externally threaded bar of said weight support member.

* * * * *